US005193695A

United States Patent [19]

Mann

[11] Patent Number: 5,193,695

[45] Date of Patent: Mar. 16, 1993

[54] LOCKING HINGE DEVICE

[76] Inventor: Peter L. Mann, Unit 1, 74 Stirling Highway, Nedlands, Western Australia, 6009, Australia

[21] Appl. No.: 656,090

[22] PCT Filed: Aug. 31, 1989

[86] PCT No.: PCT/AU89/00370

§ 371 Date: Feb. 25, 1991

§ 102(e) Date: Feb. 25, 1991

[87] PCT Pub. No.: WO90/02236

PCT Pub. Date: Mar. 8, 1990

[30] Foreign Application Priority Data

Aug. 31, 1988 [AU] Australia ..... 0168

[51] Int. Cl.[5] ..... E05D 7/04; E05D 11/10

[52] U.S. Cl. ..... 211/104; 16/351; 16/249; 211/100; 108/134; 403/84; 248/291

[58] Field of Search ..... 16/350-353, 16/249, 297, 325, 327, 330, 342; 108/42, 47, 134, 12, 115; 211/100, 104, 168, 169.1, 169, 171; 403/84, 101, 109; 248/291, 293

[56] References Cited

U.S. PATENT DOCUMENTS

| | | | |
|---|---|---|---|
| 259,390 | 6/1882 | Hensley | 16/350 |
| 395,086 | 12/1888 | Spriggs | 16/353 |
| 475,323 | 5/1892 | Korell | 108/134 |
| 712,492 | 11/1902 | Broga | 16/350 |
| 818,285 | 4/1906 | Poole | 16/351 |
| 872,650 | 12/1907 | Gilroy | 16/330 |
| 2,895,617 | 7/1959 | Orser | 108/134 |
| 3,423,786 | 1/1969 | Arias, Jr. . | |
| 3,744,085 | 7/1973 | Griego | 16/330 |
| 4,926,685 | 5/1990 | Shannon | 403/84 |

FOREIGN PATENT DOCUMENTS

| | | | |
|---|---|---|---|
| 130038 | 2/1946 | Australia . | |
| 141239 | 2/1949 | Australia . | |
| 492795 | 1/1977 | Australia . | |
| 2922763 | 12/1980 | Fed. Rep. of Germany | 16/325 |
| 2949132 | 6/1981 | Fed. Rep. of Germany . | |
| 3614881 | 10/1987 | Fed. Rep. of Germany . | |
| 911129 | 6/1946 | France . | |
| 2494756 | 5/1982 | France . | |
| 86/07111 | 12/1986 | PCT Int'l Appl. . | |
| 375628 | 6/1932 | United Kingdom . | |
| 795152 | 5/1958 | United Kingdom | 248/291 |
| 1369487 | 10/1974 | United Kingdom . | |
| 1375201 | 11/1974 | United Kingdom . | |
| 1431673 | 4/1976 | United Kingdom . | |
| 1444556 | 8/1976 | United Kingdom . | |
| 2156425 | 10/1985 | United Kingdom . | |

*Primary Examiner*—Robert L. Spruill
*Assistant Examiner*—Donald M. Gurley
*Attorney, Agent, or Firm*—Reising, Ethington, Barnard, Perry & Milton

[57] ABSTRACT

Hinge device (10, 10') having a tubular member (12, 12') and an elongate member (14, 114'). The elongate member (14, 14') is slideable in the tubular member (12, 12'). The elongate member (14, 14') comprises a first portion (28, 28') and a second portion (16, 16'). When the first portion (28, 28') is positioned inside the tubular member (12, 12') the elongate member (14, 14') is swivelable about its longitudinal axis (24, 24'). When the second portion (16, 16') is positioned inside the tubular member (12, 12') the elongate member (14, 14') is not swivelable about its longitudinal axis (24, 24').

14 Claims, 10 Drawing Sheets

LOCKING HINGE DEVICE

DESCRIPTION

The present invention relates to a locking hinge device.

FIELD OF THE INVENTION

The present invention provides a locking hinge device which allows swivel or pivotal movement in a first arrangement and prevents such movement in a second arrangement.

SUMMARY OF THE INVENTION

In accordance with one aspect of the present invention there is provided a hinge device comprising a first channel member provided as part of the mounting means arranged to be attached to a support and a second member slidably arranged in the first channel member.

The second member has a substantially longitudinal axis which extends substantially axially therethrough. The second member comprises two first portions and a second portion. The second portion is disposed intermediate the two first portions and the first and second portions are arranged substantially colinearly. The first channel member and second portion of the second member have transverse cross-sectional shapes which are mating non-circular configuration and the two first portions have cross-sectional dimensions which are less than the cross-sectional dimension of the second portion. The second member is swivelable about the substantially longitudinal axis when one of the first portions of the second member is located in the first channel member such that the leaf member is pivotable by way of the locking hinge device. The second member is not swivelable about the substantially longitudinal axis when at least a part of the second portion of the second member is located in the first channel member such that the leaf member is not pivotal and is locked in position by the locking hinge device. The leaf member is lockable in at least a first position and a second position. The first position is substantially vertical and the second position is substantially horizontal. The frame further comprises side frame members extending from respective ends of the second member in an offset manner and arranged to delimit the slidable movement of the second member.

Preferably, the channel member is provided as a tubular member.

The locking hinge device of the present invention will hereinafter be described with particular reference to its use with the leaf member being a clothes line or a bait-board and providing a pivotal mechanism therefor.

The bait-board is particularly intended for attachment to a boat.

However, the locking hinge device of the present invention is of general applicability and is not limited in its application to the specific embodiments described and illustrated herein.

DESCRIPTION OF THE INVENTION

Figure 1:
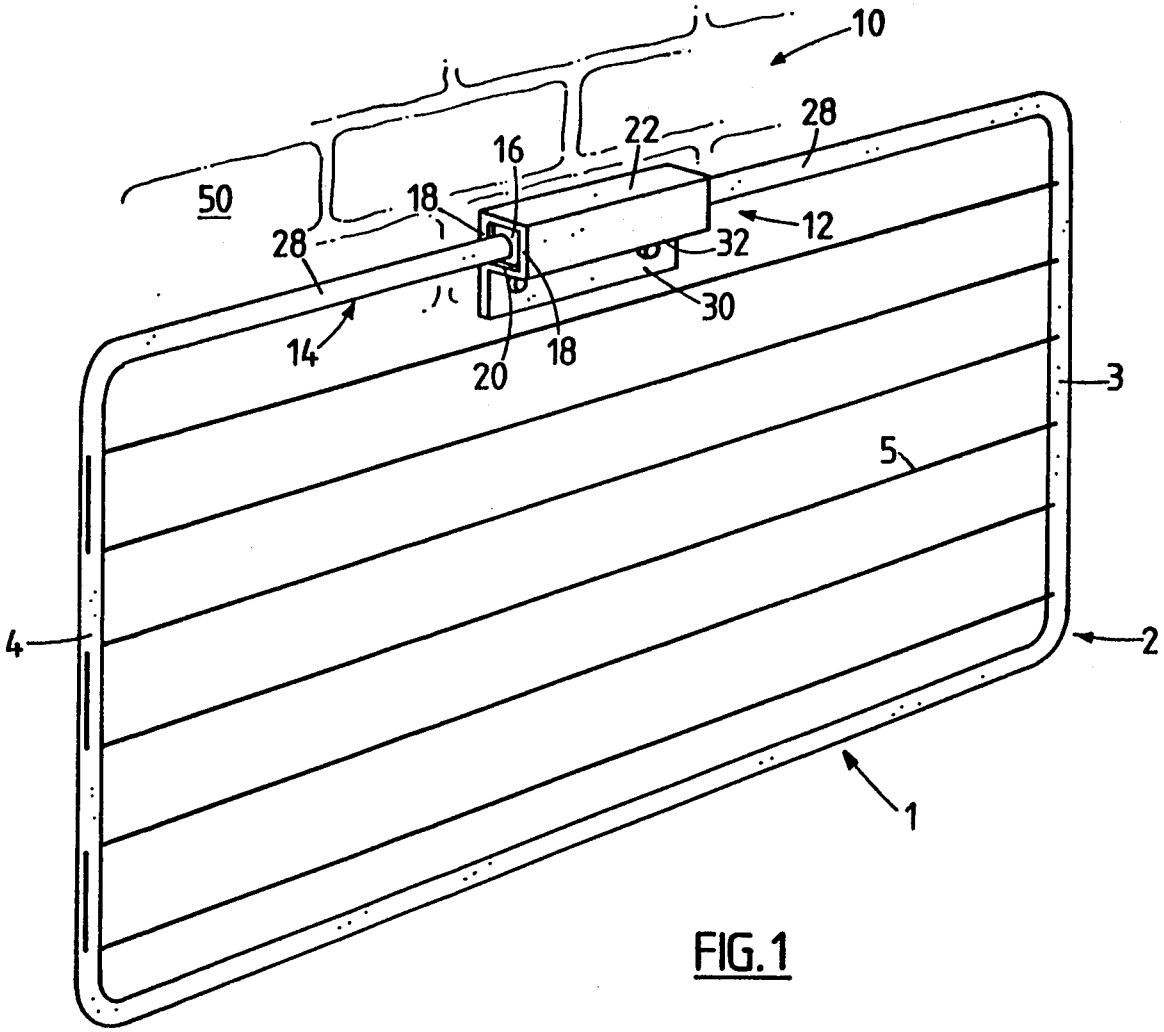
FIG. 1 is a first perspective view of an embodiment of the locking hinge device of the present invention incorporated into a clothes line, with the hinge device arranged in a first position.
Figure 2:
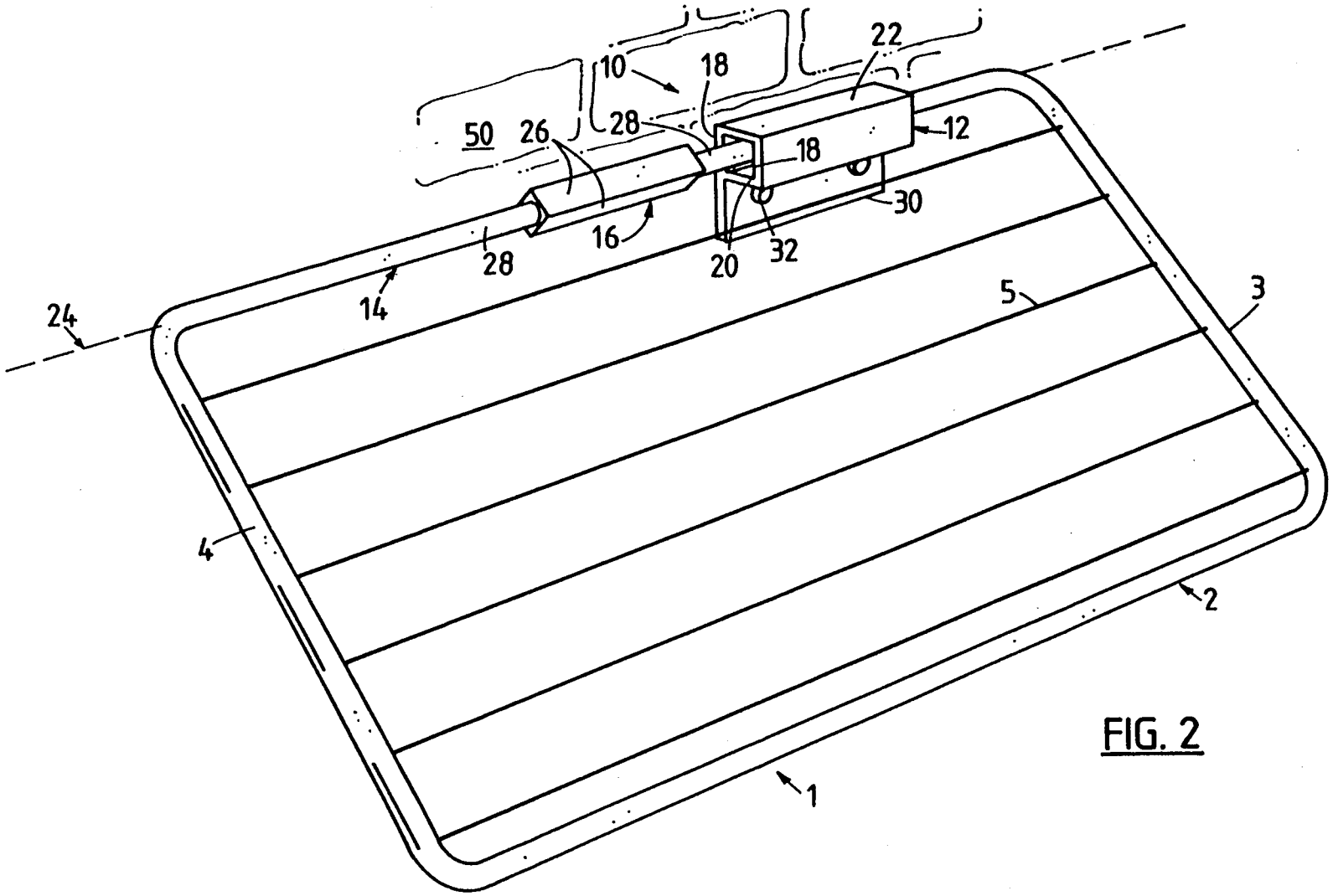
FIG. 2 is a second perspective view of the hinge device shown in FIG. 1, with the hinge device arranged in a second position illustrating swivel movement.
Figure 3:
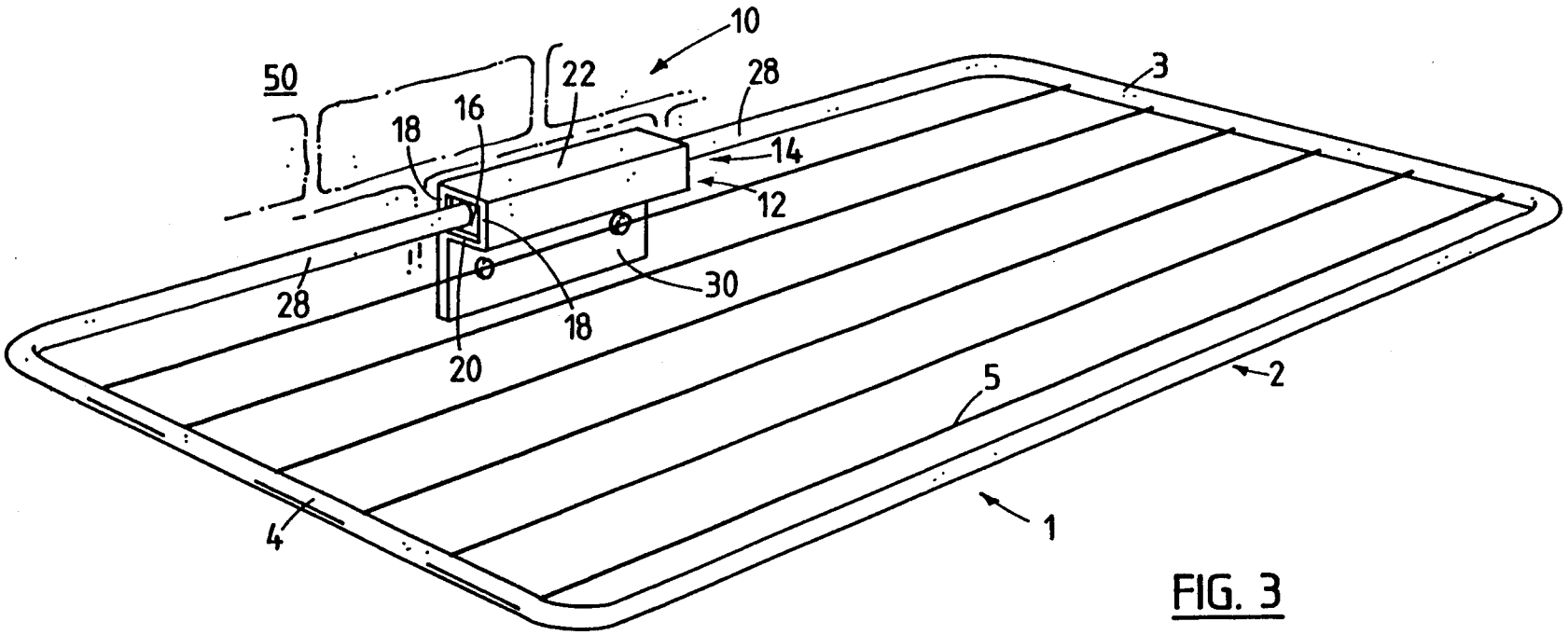
FIG. 3 is a third perspective view of the hinge device shown in FIG. 1, with the hinge device arranged in a third position.

In FIGS. 1 to 3, there is shown a leaf member in the form of a clothes line 1 incorporating a locking hinge device 10 in accordance with the present invention.

The hinge device 10 comprises a first tubular member 12 and a second elongate member 14. The elongate member 14 is provided with a portion 16 of enlarged cross-sectional size. The tubular member 12 comprises side walls 18 connected by a lower wall 20 and an upper wall 22. The side walls 18 and the lower wall 20 form a channel. The elongate member 14 has a longitudinal axis 24 (shown in FIG. 2). The portion 16 of the elongate member 14 is substantially square shaped in cross-section. The tubular member 12 is also substantially square shaped in cross-section. The elongate member 14 is longitudinally slidable in the tubular member 12, in the direction of the longitudinal axis 24. The portion 16 is dimensioned such that its side surfaces 26 are in sliding contact with the inside surfaces of the side walls 18, lower wall 20 and upper wall 22 when the portion 16 is contained in the tubular member 12. Accordingly, the elongate member 14 is not swivellable about its longitudinal axis 24 when the portion 16 is inside the tubular member 12.

The portion 16 is of substantially the same length as the tubular member 12.

The elongate member 14 comprises portions 28, adjacent the ends of the portion 16, such that the portion 16 and the portions 28 are substantially colinear. The portions 28 have a cross-sectional size that allows the elongate member 14 to be swivellable about its longitudinal axis 24 when one of the portions 28 is inside the tubular member 12. The portion 16 is substantially equally spaced from respective ends of the elongate member 14.

The elongate member 14 forms a frame member part of a frame 2 of the clothes line 1. The portions 28 of the elongate member 14 are formed integrally with the remainder of the frame 2. The frame 2 is of substantially oblong form. Two shorter side frame members 3 and 4 of the frame 2 extend from respective ends of the elongate member in an offset manner. The frame members 3 and 4 are provided with opposed apertures therein. A line or cord 5 is threaded through the apertures in the members 3 and 4 and extends back and forth between the members 3 and 4 in conventional manner. Clothes and other items to be dried or aired may be hung from the line 5 using pegs, in conventional manner. The frame 2 of the clothes line 1 may be made from light weight tubular material, e.g. aluminium. One of the side walls 18 of the tubular member 12 has a plate 30 extending therefrom. The plate 30 is provided with apertures therein.

Figure 4:
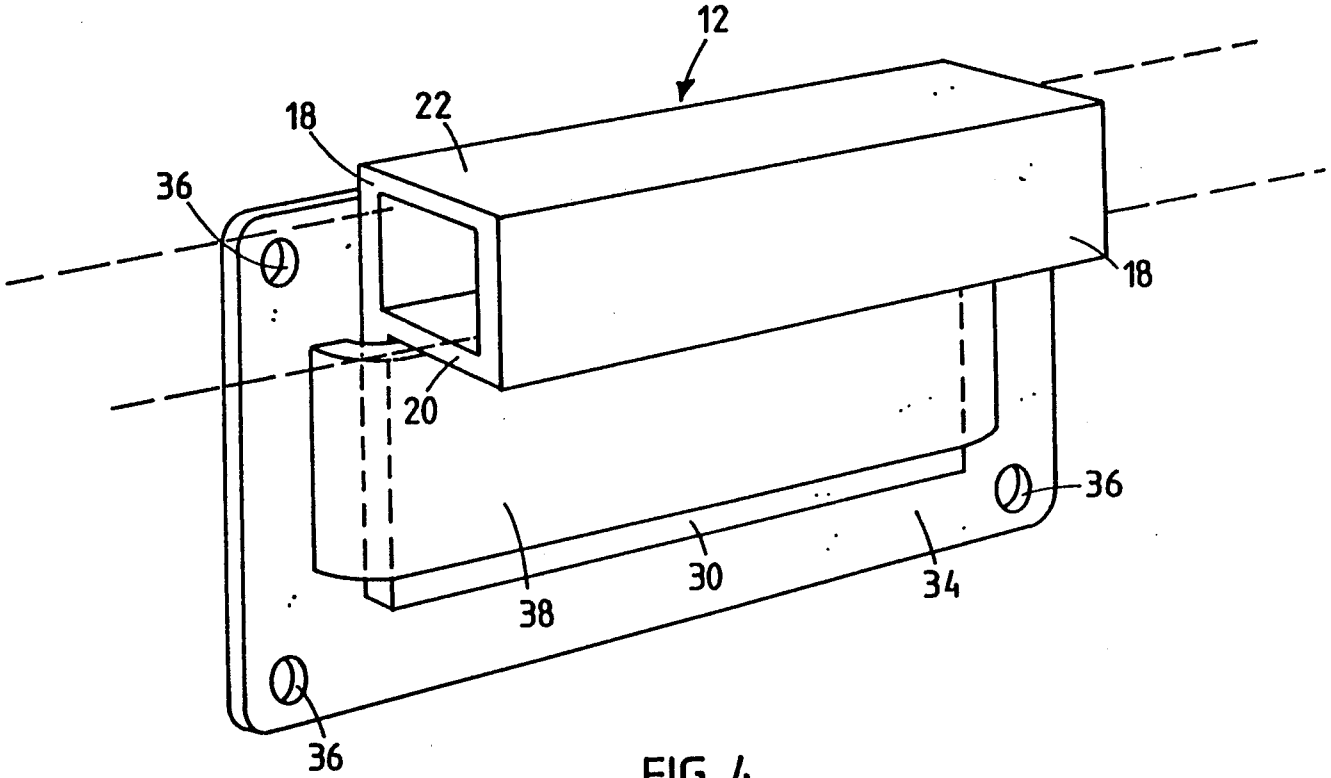
FIG. 4 is a perspective view of a bracket to attach the hinge device shown in FIG. 1 to a support.

The hinge device 10 (and thereby the clothes line 1) may be attached to a support using bolts 32 threaded through the apertures in the plate 30 and embedded in the support. In FIGS. 1 to 3, the support is shown as a brick wall 50. FIG. 4 shows an alternative arrangement for affixing the hinge device 10 to a support.

In FIG. 4, there is shown a bracket 34 having apertures 36 therein. The bracket 34 may be attached to a support (not shown) by threading bolts (not shown) through the apertures 36 and embedding them in the support.

The bracket 34 is of substantially plate form and is provided with a pushed out portion 38. The pushed out portion 38 forms a slot with the remainder of the bracket 34 into which the plate 30 of the hinge device 10 can fit to thereby hold and support the hinge device 10. This is shown in FIG. 4.

The manner of use and operation of the hinge device 10 incorporated in the clothes line 1 shown in FIGS. 1 to 3 will now be described.

In FIG. 1, the hinge device 10 is arranged with the portion 16 positioned inside the tubular member 12. The frame 2 of the clothes line 1 extends downwardly, and lies adjacent the brick wall 50. In this position, the surfaces 26 of the portion 16 are in sliding contact with the inside surfaces of the side walls 18, lower wall 20 and upper wall 22 of the tubular member 12 and the elongate member 14 is prevented from swivelling about its longitudinal axis 24. The hinge device 10 is placed in this position when the clothes line 1 is not in use.

When it is required to use the clothes line 1, the elongate member 14 is slid longitudinally, in the direction of the longitudinal axis 24, inside the tubular member 12 until the portion 16 is positioned outside the tubular member 12 and one of the portions 28 is inside the tubular member 12. This position is shown in FIG. 2.

In the position shown in FIG. 2, the elongate member 14 is swivellable about its longitudinal axis 24 since the inside surfaces of the side walls 18, lower wall 20 and upper wall 22 do not interfere with the portions 28. The frame 2 of the clothes line 1 may be pivoted in an upward direction about the longitudinal axis 24 of the elongate member 14. The frame 2 is pivoted upwardly through substantially 90° until the frame 2 of the clothes line 1 is substantially horizontal. The elongate member 14 is then slid in the tubular member 12 such that the portion 16 is contained therein. This is shown in FIG. 3. In this position, the elongate member 14 is prevented from swivelling about its longitudinal axis 24.

When the clothes line 1 is in the position shown in FIG. 3, clothes and/or other items (not shown) may be hung from the line 5.

When the clothes line 1 is no longer in use, the elongate member 14 is again slid in the tubular member 12 until the portion 16 is positioned outside the tubular member 12 and one of the portions 28 is inside the tubular member 12. (This position is shown in FIG. 2).

The frame 2 is then pivoted downwardly through substantially 90° until the frame 2 of the clothes line 1 is substantially vertical. As can be seen from the drawings, the frame 2 could, alternatively, be pivoted upwardly through 90° to be vertical.

The elongate member 14 is then slid in the tubular member 12 such that the portion 16 is contained therein. This is shown in FIG. 1. The elongate member 14 is thus prevented from swivelling about its longitudinal axis 24. As can be seen from the drawings, the frame members 3 and 4 are arranged to delimit the slidable movement of the elongate member 14 along the longitudinal axis 24.

The hinge device 10 may alternatively be held by the bracket 34 shown in FIG. 4 which is itself attached to a support, as hereinbefore described. The hinge device 10 may be removed from the bracket 34 and the clothes lines 1 stored away leaving only the bracket 34 attached to the support. The bracket 34 may be attached to any suitable support. For instance, the bracket 34 may be attached to a vehicle, e.g. a caravan or camper, such that the hinge device 10 of the clothes line 1 may be placed in position in the bracket 34 when in use and removed for storage and travel.

Figure 8:
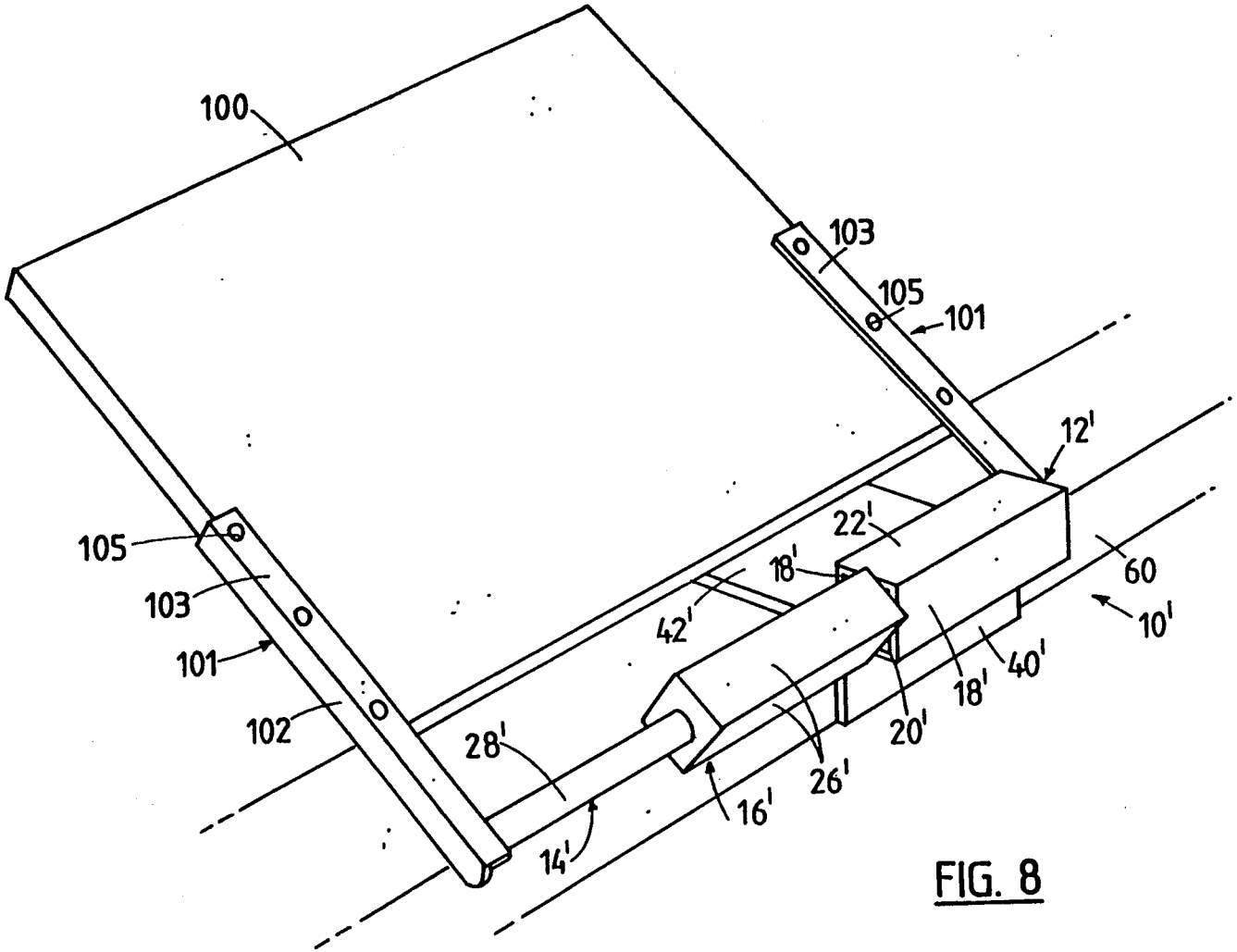
FIG. 8 is a fourth perspective view of the hinge device shown in FIG. 5, with the hinge device arranged in a fourth position illustrating swivel movement.
Figure 9:
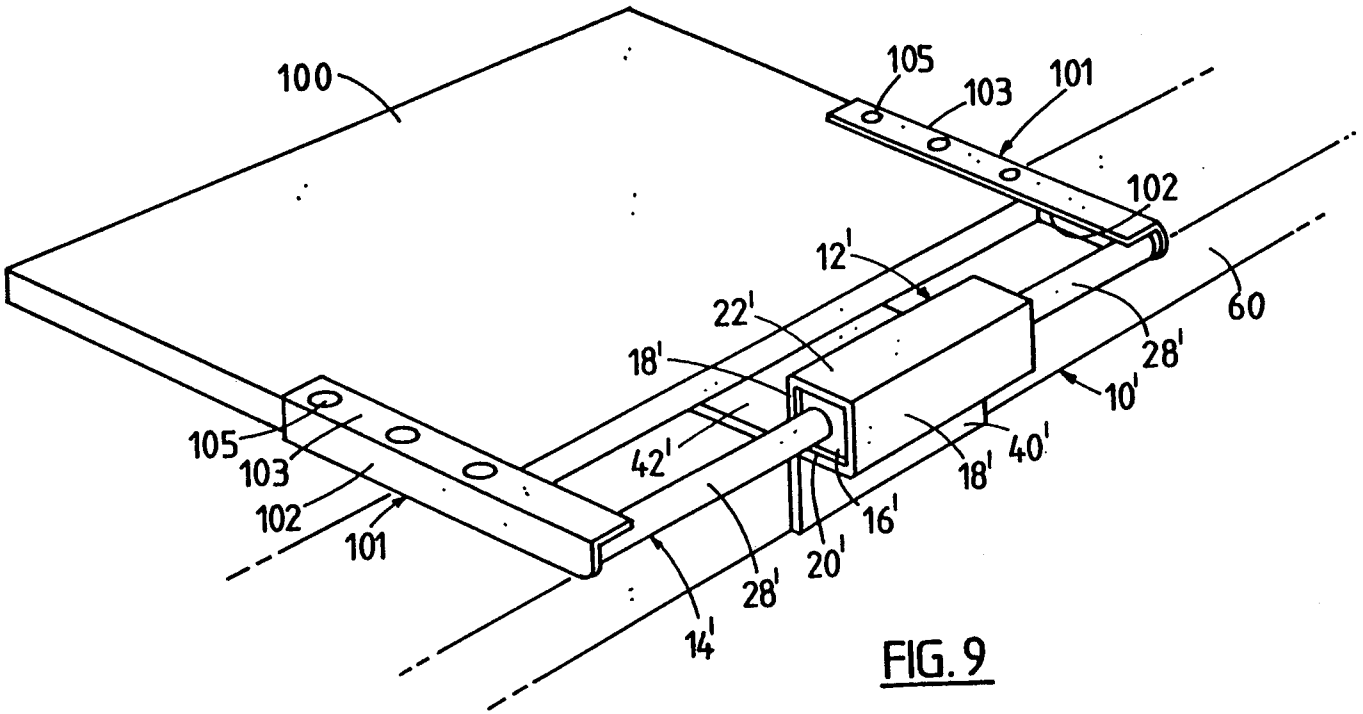
FIG. 9 is a fifth perspective view of the hinge device shown in FIG. 5, with the hinge device arranged in a fifth position.
Figure 10:
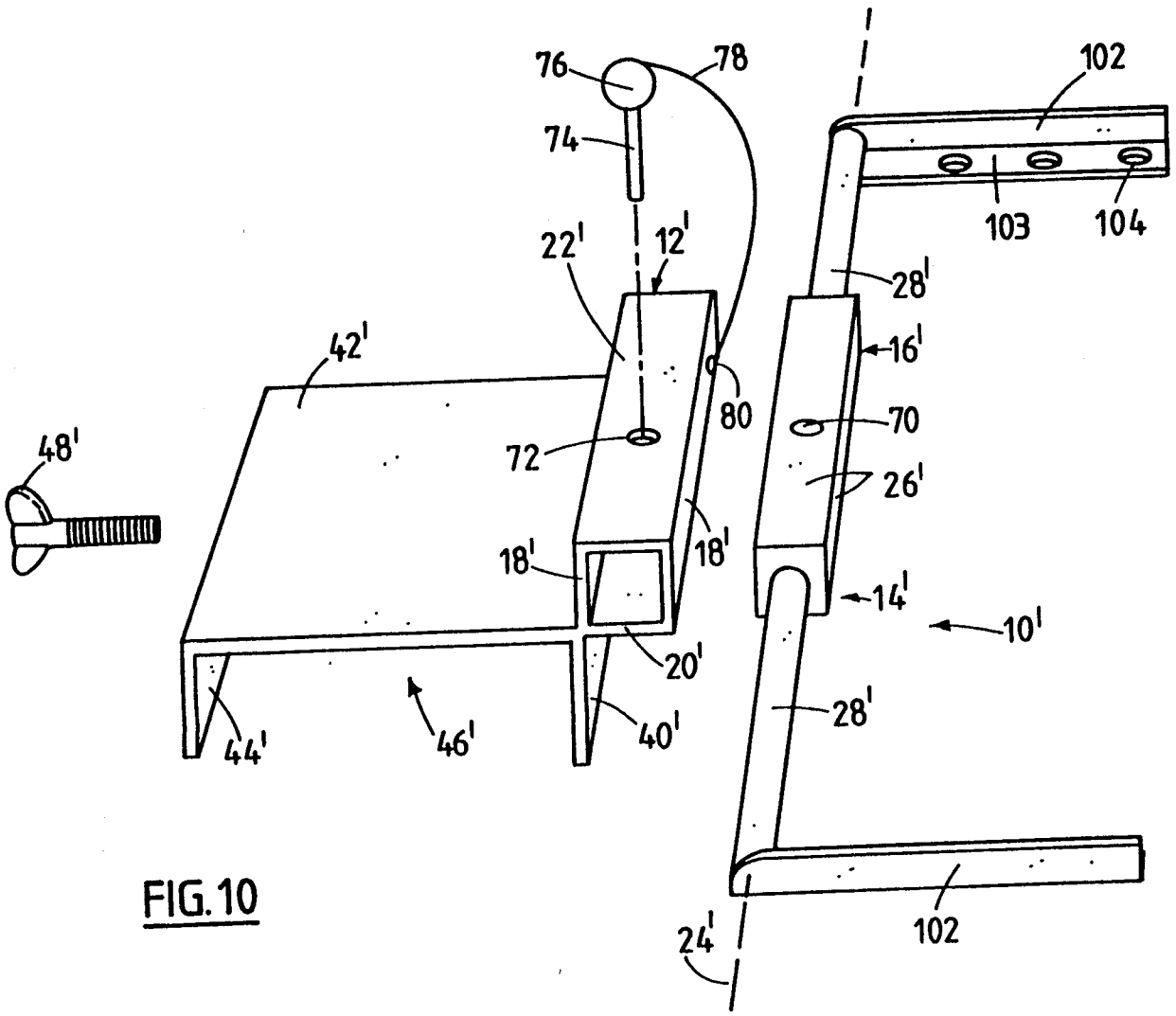
FIG. 10 is a perspective view of the hinge device shown in FIG. 5, but without the bait-board, and having means to prevent the elongate member from sliding when the enlarged portion thereof is in the tubular member.

In FIGS. 5 to 9, there is shown a leaf member in the form of a bait-board 100 attached to a locking hinge device 10' in accordance with the present invention, whilst in FIG. 10, there is shown the hinge device 10' without the bait-board 100 to show the structure of the arms attached to the hinge device 10'. FIG. 10 also shows means for preventing sliding movement of the elongate member when the enlarged portion thereof is in the tubular member.

The hinge device 10' shown in FIGS. 5 to 10 is essentially of the same form as the hinge device 10 shown in FIGS. 1 to 3. Accordingly, the same reference numerals have been used to identify the same parts in FIGS. 5 to 10 and FIGS. 1 to 3. A superscript is, however, used in FIGS. 5 to 10 to clarify the particular drawings which are being described in the specification.

The similarity of structure of the hinge devices 10 and 10' will be evident from the identical reference numerals and the description of such structure will not be herein repeated. It is, however, to be understood that the description of the hinge device 10 applies to the hinge device 10', except as modified by the following description. A bait-board 100 is attached to the portions 28' of the elongate member 14' via side frame members or arms 101. The arms 101 extend transversely from the free end of each portion 28' in the same direction.

The arms 101 comprise a pair of narrow plate members 102 and 103 and are substantially "L" shaped in cross-section. The narrow plate members 103 are provided with a series of apertures 104. This can be seen in FIG. 10.

The bait-board 100 is attached to the arms 101 by way of any suitable attachment means 105, e.g. screws, rivets, etc. In this way, the elongate member 14' and the arms 101 form a frame of the bait-board 100, as can be seen in FIGS. 5–10. One of the side walls 18' of the tubular member 12' has a plate 40' extending therefrom. Similarly, the lower wall 20' has a plate 42' extending therefrom. Another plate 44' extends from the end of the plate 42' in a downward manner in the same direction as the plate 40'.

The plates 40', 42' and 44' define a channel 46' (best seen in FIG. 10) which is arranged to fit over the gunwale 60 of a boat.

The plate 42' may be of adjustable width such that it may accommodate gunwales of different widths. A clamp screw 48' is provided to tighten the hinge device 10' to the gunwale 60.

Figure 7:
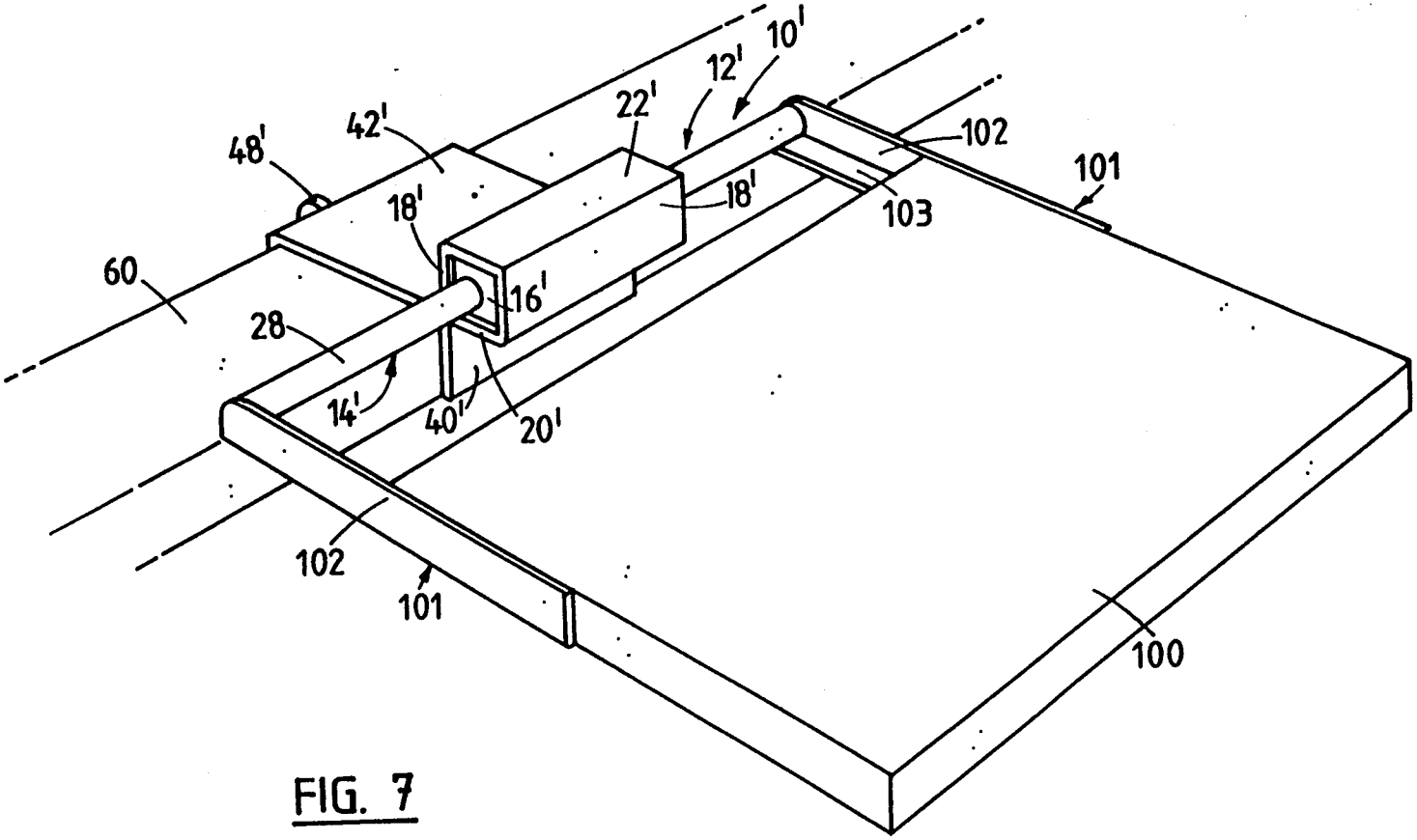
FIG. 7 is a third perspective view of the hinge device shown in FIG. 5, with the hinge device arranged in a third position.

The hinge device 10' is also provided with lock means to prevent the elongate member 14' from sliding along its longitudinal axis 24' (shown in FIG. 10) when the portion 16' is positioned in the tubular member 12'. This lock means comprises a bore 70 extending through the portion 16', a hole 72 in the upper wall 22' of the tubular member 12' and a pin 74. The bore 70 and the hole 72 are provided such that they are aligned when the portion 16' is in the tubular member 12' and the bait-board 100 is in a horizontal position, i.e. as shown in FIG. 7 or FIG. 9. The pin 74 is provided with a knob 76 and is connected by a chain 78 to the tubular member 12' to which it is affixed by a stud 80. Alternatively, the bore 70 and hole 72 may be provided on alternative surfaces 26' and the walls 18' of the portion 16' and tubular member 12', respectively.

When the portion 16' is in the tubular member 12' such that the bore 70 and hole 72 are aligned, the pin 74 may be inserted thereinto. This prevents the elongate member 14' from sliding along its longitudinal axis 24'.

Figure 5:
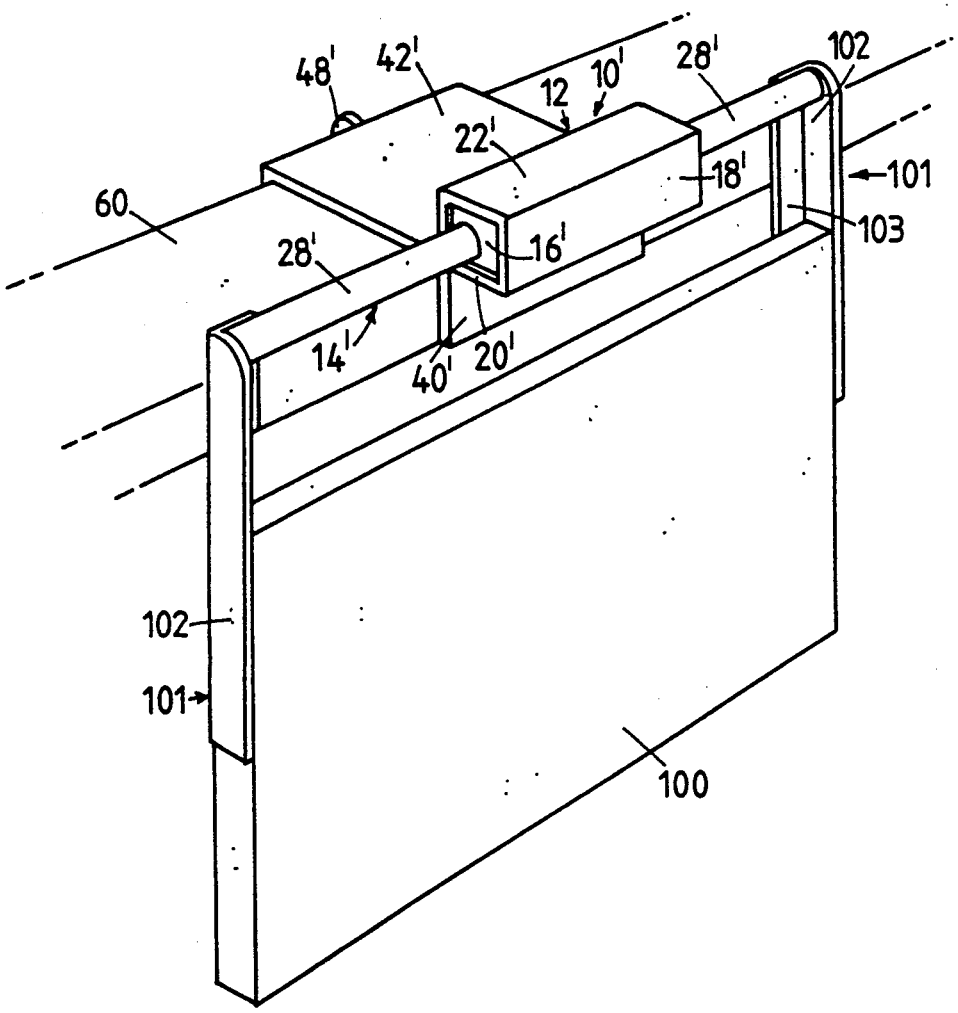
FIG. 5 is a first perspective view of an embodiment of the hinge device of the present invention attached to a bait-board, with the hinge device arranged in a first position.

A second bore (not shown) may also be provided extending between the other two surfaces 26' of the portion 16' which could be used to prevent the tubular member from sliding when the bait-board is in its non-use position, i.e. as shown in FIG. 5.

The manner of use and operation of the hinge device 10' attached to the bait-board 100 is the same as hereinbefore described with reference to the hinge device 10. FIGS. 5 to 9 show the hinge device 10', having a bait-board 100 connected thereto, attached to the gunwale 60 of a boat via the plates 40', 42' and 44' and the clamp screw 48'. The tubular member 12' and the plate 40' are positioned on the inside of the boat whilst the plate 44' is positioned on the outside of the boat.

Figure 6:
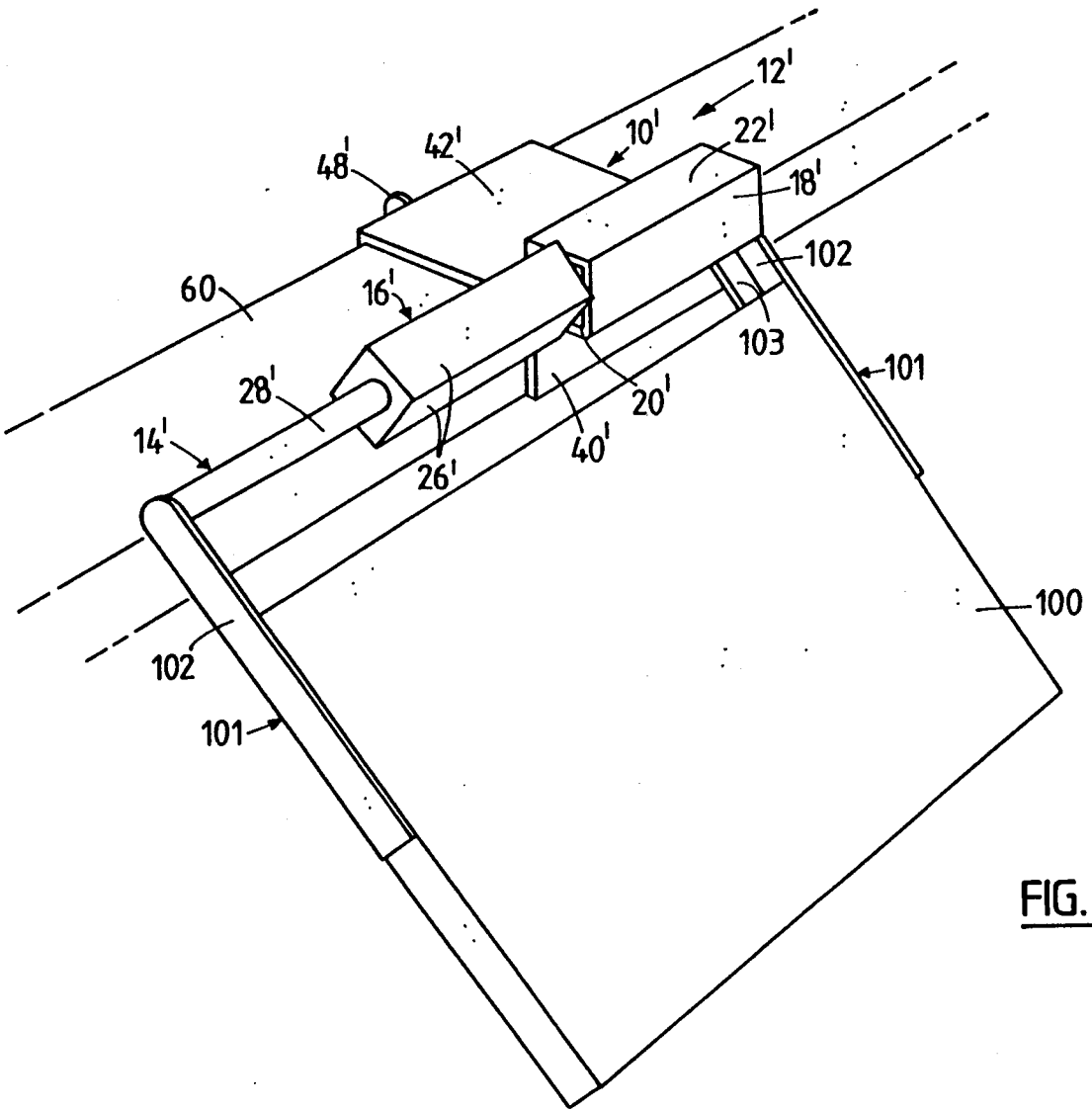
FIG. 6 is a second perspective view of the hinge device shown in FIG. 5, with the hinge device arranged in a second position illustrating swivel movement.

FIG. 5 shows the bait-board 100 when not in use. The portion 16' is positioned inside the tubular member 12' preventing the elongate member 14' from being swivelled. FIG. 6 shows the portion 16' removed from the tubular member 12' allowing the elongate member 14' to be swivelled about its longitudinal axis 24'.

The elongate member 14' may be swivelled upwardly through substantially 90° and the portion 16' reinserted into the tubular member 12' as shown in FIG. 7. This prevents the elongate member 14' from being swivelled. In this position, the bait-board 100 provides a first working surface for a user.

The elongate member 14' may also be swivelled upwardly and then outwardly through substantially 270°, as shown in FIG. 8, and the portion 16' reinserted into the tubular member 12' as shown in FIG. 9. In this position, the bait-board 100 provides a second working surface for a user. The bait-board 100 may be returned to its non-use position shown in FIG. 5 by removing the portion 16' from the tubular member 12' such that the bait-board 100 is pivoted back to the position shown in FIG. 5.

In the position shown in FIG. 7, the bait-board 100 provides a working surface extending over the inside of the boat.

In the position shown in FIG. 9, the bait-board 100 provides a working surface extending over the gunwale 60 of the boat on the outside thereof. This position is particularly useful for scaling fish or performing other operations which may produce debris. Any such debris falls into the water rather than into the boat.

The elongate member 14' may be prevented from sliding using the bore 70, hole 72 and pin 74 as hereinbefore described. As an alternative to the use of the plates 40', 42' and 44' and the clamp screw 48' to attach the hinge device 10' to the gunwale 60 a bracket 34 of the type shown in FIG. 4 may be used. The bracket 34 is provided on the inside surface of the side of the boat, e.g. on the gunwale 60. In such a case, the plates 40', 42' and 44' would be omitted and a plate 30 of the type used with the hinge device 10 substituted therefor.

The lock means for preventing sliding movement of the elongate member 14' when the portion 16' is in the tubular member 12' may also be provided in the hinge device 10 of FIGS. 1 to 3. However, the lock means has been shown only in FIG. 10 as the other figures do not afford clarity of representation of this feature.

Whilst the hinge device of the present invention has been described with particular reference to its use with a leaf member in the form of a clothes lines and a bait-board, it is understood that it is of general applicability to any uses for which it is suitable.

Further, whilst the tubular members 12 and 12' and the portions 16 and 16' of the hinge device 10 and 10' have been described and illustrated as having a square cross-section, the present invention is not limited to such a shape. Accordingly, any suitable cross-section may be used which prevents the elongated member 14, 14' from swivelling when the portion 16, 16' is inside the tubular member 12, 12'. Modifications and variations such as would be apparent to a skilled addressee are deemed within the scope of the present invention.

I claim:

1. Locking hinge device comprising:

mounting means arranged to be attached to a support and including a first channel member;

a frame of a leaf member which is pivotable and lockable by way of said locking hinge device;

said frame including a frame member comprising a second member slidably arranged in said first channel member, said second member having a substantially longitudinal axis which extends substantially axially therethrough;

said second member comprising two first portions and a second portion, said second portion being disposed intermediate said two first portions and said first and second portions being arranged substantially colinearly;

said first channel member and said second portion of said second member having transverse cross-sectional shapes which are of mating non-circular configuration and said two first portions having cross-sectional dimensions which are less than the cross-sectional dimension of said second portion for allowing said second member to swivel about said substantially longitudinal axis when one of said first portions of said second member is located in said first channel member such that said leaf member is pivotable by way of said locking hinge device, and for preventing said second member from swivelling about said substantially longitudinal axis when at least a part of said second portion of said second member is located in said first channel member such that said leaf member is not pivotable and is locked in position by said locking hinge device, said leaf member being lockable in at least a first position and a second position, said first position being substantially vertical and said second position being substantially horizontal;

said frame further comprising side frame members extending from respective ends of said second member in an offset manner and arranged to delimit the slidable movement of said second member.

2. Locking hinge device according to claim 1, wherein said first channel member and said first and second portions of said second member have cross-sections which enable said second portion to slide in said channel member but prevent said second member from swiveling about said longitudinal axis when a part of said second portion is in said first channel member, and which enable said second member to swivel about said longitudinal axis when one of said first portions is in said channel member.

3. Locking hinge device according to claim 2, wherein said channel member is provided with an upper wall to thereby define a tubular member.

4. Locking hinge device according to claim 2, wherein said first channel member and said second portion have square cross-sections.

5. Locking hinge device according to claim 1, comprising means cooperating with said first channel member and said second member for preventing said second member from sliding along said longitudinal axis when said second portion is in said first channel member.

6. Locking hinge device according to claim 5, wherein said means comprises at least one bore provided in said second portion, at least one hole provided in said first channel member, and pin means such that when said second portion is in said first channel member and said bore and hole are aligned said pin means is insertable thereinto to prevent said sliding of said second member.

7. Locking hinge device according to claim 1, wherein said mounting means comprises a plate which extends from said first channel member such that said plate is attachable to said support.

8. Locking hinge device according to claim 1, wherein said mounting means comprises a bracket which is attachable to said support and a plate extends from said first channel member and said plate is removably receivable in a slot of said bracket.

9. Locking hinge device according to claim 1, wherein said mounting means comprises first, second and third plates, said first and second plates extending from said first channel member and said third plate extending from said second plate such that said first, second and third plates define a channel into which said support is receivable.

10. Locking hinge device according to claim 1, wherein said leaf member is lockable in a third position, said third position being substantially horizontal and spaced substantially 270° from said first position.

11. Locking hinge device according to claim 1, wherein said leaf member is lockable in a third position and a fourth position, said third position being substantially horizontal and spaced substantially 270° from said first position, and said fourth position being substantially vertical aned spaced substantially 180° from said first position.

12. Locking hinge device according to claim 1, wherein said second position is substantially equally spaced from respective said ends of said second member.

13. Locking hinge device according to claim 1, wherein said leaf member is a clothes line.

14. Locking hinge device according to claim 1, wherein said leaf member is a bait-board.

* * * * *